United States Patent [19]

Temos

[11] Patent Number: 4,790,594

[45] Date of Patent: Dec. 13, 1988

[54] MODULAR STADIUM SEATING AND ASSEMBLY METHOD

[75] Inventor: Ulis J. Temos, Nazareth, Pa.

[73] Assignee: Contour Seats, Inc., Allentown, Pa.

[21] Appl. No.: 150,449

[22] Filed: Jan. 29, 1988

Related U.S. Application Data

[63] Continuation of Ser. No. 917,105, Oct. 8, 1986, abandoned.

[51] Int. Cl.[4] ..... A47C 1/12

[52] U.S. Cl. ..... 297/248; 29/407; 29/464; 52/8; 297/444

[58] Field of Search ..... 297/248, 444; 52/8; 29/407, 464

[56] References Cited

U.S. PATENT DOCUMENTS

| | | | |
|---|---|---|---|
| D. 123,573 | 11/1940 | Rideout . | |
| D. 183,838 | 11/1958 | Hoven et al. | D15/8 |
| D. 188,185 | 6/1960 | Henrikson et al. | D15/8 |
| D. 192,245 | 2/1962 | Williams | D15/8 |
| D. 215,712 | 10/1969 | Duckett et al. | D15/8 |
| D. 224,955 | 10/1972 | Tipton | D6/197 |
| D. 238,738 | 2/1976 | Schultz | D6/194 |
| D. 238,992 | 3/1976 | Winig | D6/161 |
| D. 238,993 | 3/1976 | Schultz | D6/191 |
| D. 238,994 | 3/1976 | Schultz | D6/194 |
| D. 238,996 | 3/1976 | Schultz | D6/197 |
| D. 239,492 | 4/1976 | Schultz | D6/195 |
| 523,287 | 7/1894 | Kollenberg | 297/444 X |
| 1,955,040 | 4/1934 | Wittcoff | 297/248 X |
| 2,965,155 | 12/1960 | Henrikson et al. | 155/83 |
| 3,025,106 | 3/1962 | Evans et al. | 297/378 X |
| 3,273,937 | 9/1966 | Anderson | 297/460 X |
| 3,347,593 | 10/1967 | Walkinshaw | 297/248 |
| 3,352,069 | 11/1967 | Curra, Jr. | 52/9 |
| 3,466,087 | 9/1969 | Motter III | 297/232 |
| 3,478,473 | 11/1969 | Hoven | 52/9 |
| 3,482,874 | 12/1969 | Henebry et al. | 297/445 |
| 3,531,157 | 9/1970 | Duckett et al. | 297/248 |
| 3,554,142 | 1/1971 | Sorenson et al. | 297/248 |
| 3,640,576 | 2/1972 | Morrison et al. | 297/248 X |
| 3,657,854 | 4/1972 | Tipton | 52/8 X |
| 3,702,204 | 11/1972 | Tipton et al. | 297/248 |
| 3,981,536 | 9/1976 | Schultz | 297/248 X |
| 4,126,354 | 11/1978 | DeLong et al. | 297/248 |
| 4,133,579 | 1/1979 | Springfield | 297/452 |
| 4,244,621 | 1/1981 | Lazaroff et al. | 297/218 |
| 4,307,914 | 12/1981 | Grandclement | 297/458 |
| 4,318,570 | 3/1982 | Adam et al. | 297/444 X |
| 4,409,762 | 10/1983 | Raymond | 52/9 |
| 4,438,603 | 3/1984 | Durkan, Jr. | 52/8 |
| 4,490,949 | 1/1985 | Sutter et al. | 52/9 |
| 4,518,199 | 5/1985 | Lewis | 297/248 |
| 4,631,874 | 12/1986 | Griffin, Jr. | 52/8 |

*Primary Examiner*—Kennth J. Dorner
*Assistant Examiner*—Peter R. Brown
*Attorney, Agent, or Firm*—Bernard, Rothwell & Brown

[57] ABSTRACT

A modular stadium seating assembly includes side-by-side modular seat units mounted on a support framework fastened to a support structure of a stadium. The seat units are mounted on the support framework by clamping adjacent edge portions of adjacent seat units between a clamp-down member and the support framework. Upright backrest supports supporting backrest modules above the seat units are connected to and supported by corresponding clamp-down members. The backrest supports include generally U-shaped sidewardly open slots for mating with and supporting corresponding side portions of backrest modules. Top caps are fastenable over the U-shaped slots to secure backrest modules into backrest supports. The supporting framework for a seating section is fastened to the stadium support structure at mount locations which are positioned in a line extending between corresponding mount locations in top and bottom rows of a seating section.

10 Claims, 7 Drawing Sheets

FIG. 11
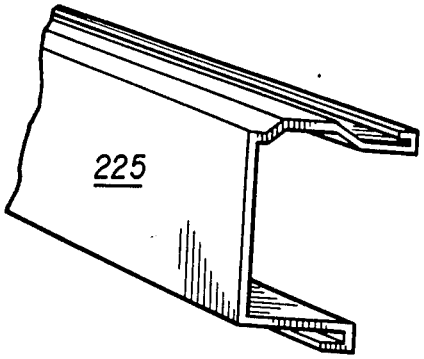
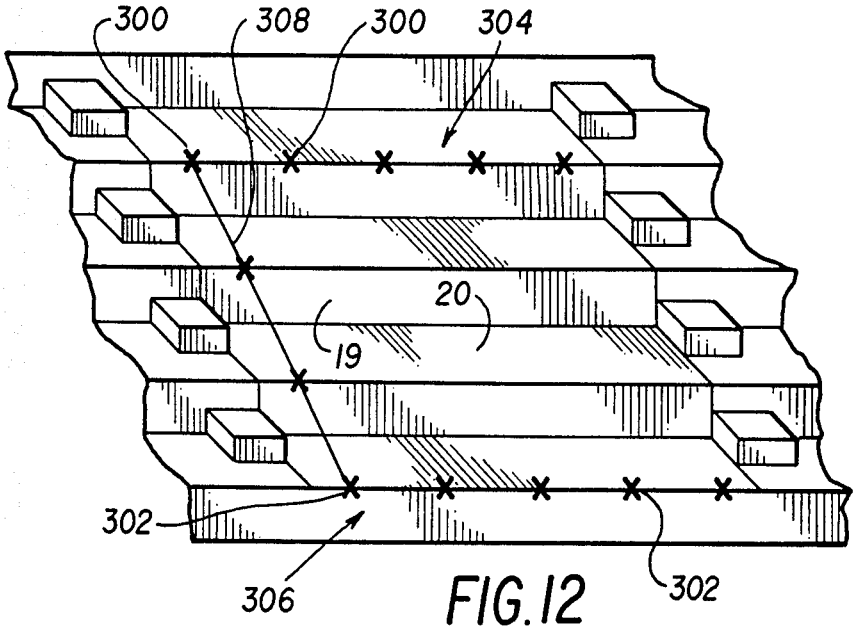
FIG. 12
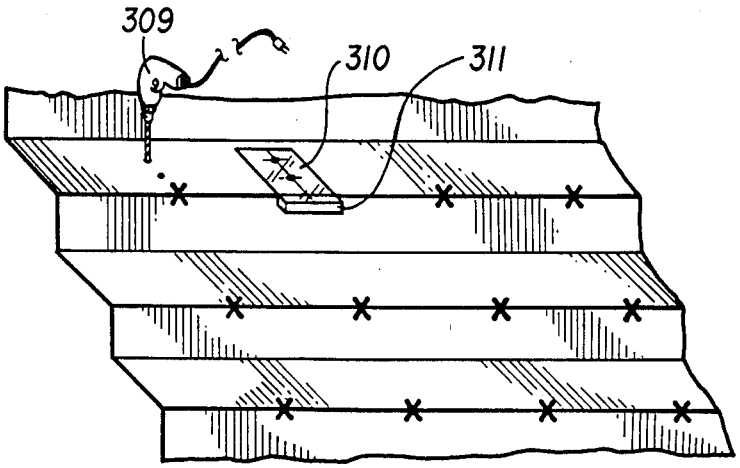
FIG. 13

MODULAR STADIUM SEATING AND ASSEMBLY METHOD

This is a continuation of application Ser. No. 917,105, filed Oct. 8, 1986, now abandoned.

BACKGROUND OF THE INVENTION

1. Field of the Invention

The present invention relates to modular stadium seating and to a method for assembling modular stadium seating.

2. Description of the Backround Art

The use of modular spectator seating in stadiums and the like wherein individually contoured seats of molded plastic material are assembled in juxtaposition on a metal structure has become widely accepted.

One such modular seating construction is described in U.S. Pat. No. 3,702,204 to Tipton et al. showing modular seating units assembled on a pair of rails supported by T-shaped brackets connected to risers or treads of a stepped stadium base. The Tipton et al. construction utilizes bolts which are slidable within slots along the tops of the rails connected to barrel nuts for fastening seat modules to the rails. Assembly of modular seating using Tipton's sliding bolt/barrel nut combination makes assembly of the seating difficult under some conditions, particularly in cold weather.

Stadium seating desirably includes backrests for the comfort of the users. U.S. Pat. No. 3,981,536 to Schultz shows a back system for modular seating wherein backrest modules are carried by upright supports attached to the seating. The backrest modules are fixed to the supports by means including clips. The clips utilized according to this Schultz patent simultaneously fix adjacent sides of adjacent backrest modules to an upright backrest support situated between the modules. With this construction, if it is desired to remove a single backrest module for replacement or repair thereof, removal of the clips on the sides of the module also removes support for backrest modules of the immediately adjacent seats.

For economic reasons, it is desirable to assemble modular stadium seating in as efficient a manner as possible. U.S. Pat. No. 3,657,854 to Tipton discloses a method for installing modular stadium seating utilizing a template which is turned end-over-end to mark the positions for mounting upright supports to risers. Although this assembly method may be suitable in some circumstances, other and more efficient stadium seat assembly methods are desirable.

There remains a need in the art for modular stadium seating which is relatively easy to assemble, and for efficient methods for assembling stadium seating.

SUMMARY OF THE INVENTION

In accordance witn the present invention, a modular stadium seat assembly includes a plurality of adjacent side-by-side modular seat units. The seat units are supported in side-by-side relationship above a stadium support structure by a support framework. A plurality of adjacent backrest modules are positioned side-by-side above corresponding seat units to engage and rest a user's back. Clamp-down members extend over adjacent side portions of adjacent seat units, the clamp-down members being attached to the support framework with adjacent side portions of adjacent seat units sandwiched between the clamp-down members and the support framework. Upright backrest supports for suporting the backrest modules above the seat units are also provided. The backrest supoorts are connected to and supported by corresponding clamp-down members. The upright supports include generally U-shaped, sidewardly open slots for mating with and supporting corresponding side portions of the backrest modules. The U-shaped slots are defined by front and rear wall portions connected by a slot bottom wall portion. The U-shaped slots have an open top which is selectively closeable by a top cap. In the closed position, the top cap connects the front and rear wall portions of a slot and thereby form a top wall portion of the slot. To insert or remove the backrest modules from the backrest supports, the side portions of the seat backs modulate vertically slidable within corresponding open U-shaped slots between the front and rear slot wall portions with corresponding top caps removed. Fastening of the top caps with the backrest modules inserted in the slots secures the backrest modules to the backrest supports.

Modular stadium seating is assembled according to the present invention by marking mount locations for top and bottom rows of a seating section on a stepped stadium base. Mounting locations for intermediate rows are then marked in a line extending between corresponding mount locations at the top and bottom rows. A vertical plumb line is marked for each mount location on a corresponding riser. A plurality of holes are formed in the corresponding riser at each mount location for mounting a vertical riser mount with fasteners in plumb. The vertical riser mount then is fastened in plumb with fasteners inserted into the holes at each mount location. Cross-members are secured to the vertical riser mounts located at opposite ends of the rows and to an intermediate vertical riser mount generally centrally located in the rows to form generally T-shaped tower brackets at the ends of the rows and at a generally centrally located intermediate position in the rows. The cross-members are secured to the end riser mounts and the intermediate riser mount of a row at about the same angle. Front and rear elongate rail members are hung and fastened on respective front and rear ends of the cross-members of the end tower brackets and the intermediate tower bracket of a row, and secured to interconnect the end tower brackets and the intermediate tower brackets of a row. Cross-members then are fastened to remaining intermediate riser mounts and to each of the rails in a row at about the same angle as the end tower brackets to interconnect the remaining intermediate riser mounts on the rails in a row to form a seat supporting framework. Seat units then are mounted on the thus assembled framework.

BRIEF DESCRIPTION OF THE DRAWINGS

FIG. 11 is a perspective, partly schematic view of a rail extender according to the invention.

FIGS. 12–16 are partly schematic, perspective views showing sequential assembly of a supporting framework according to another embodiment of the invention.

DETAILED DESCRIPTION OF THE PREFERRED EMBODIMENTS

Figure 1:
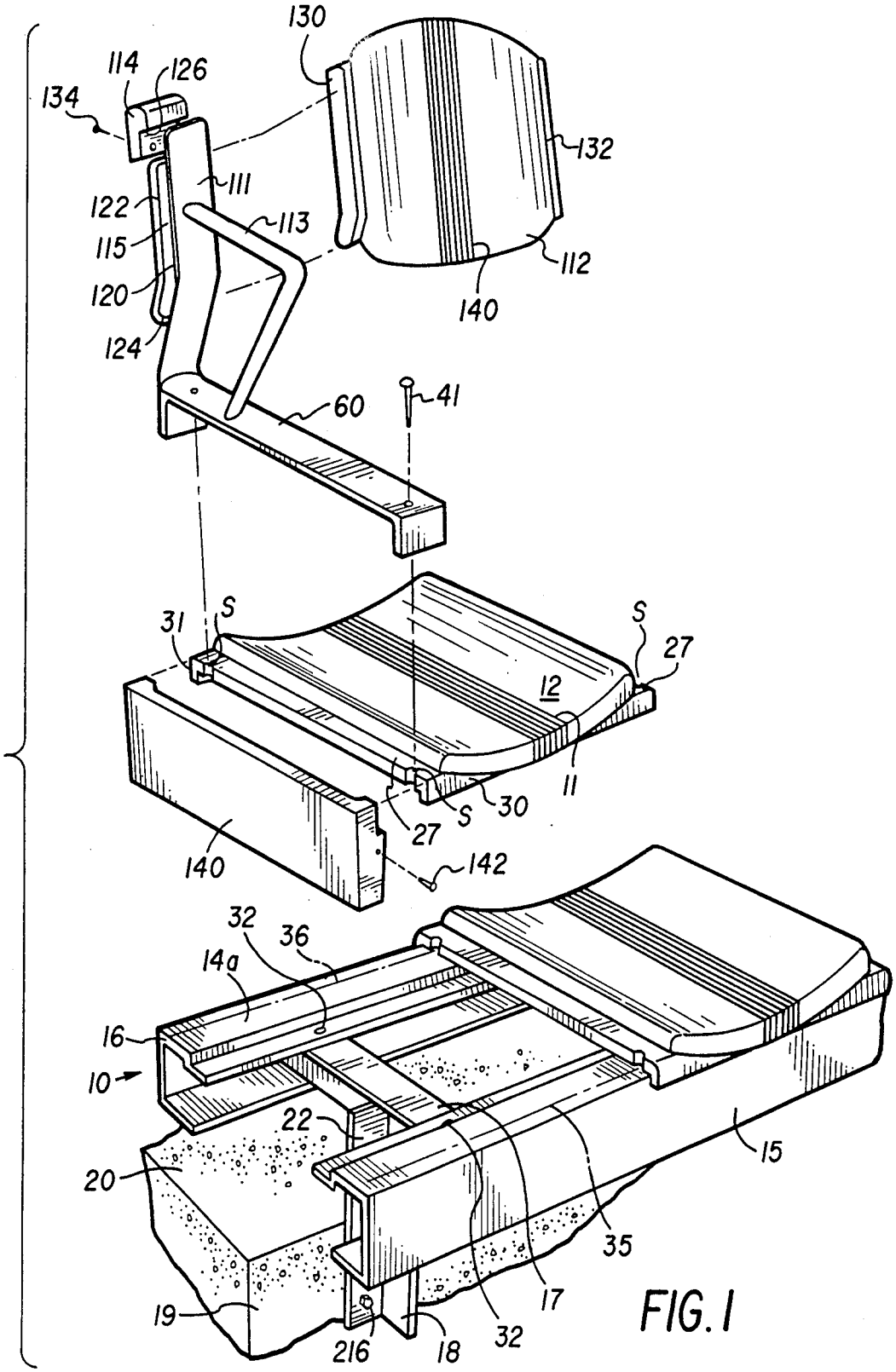
FIG. 1 is a partially exploded perspective view of a modular seating assembly according to the present invention.

With reference to the drawings, a modular stadium seat assembly according to the present invention includes a framework 10 advantageously fabricated of metal parts such as aluminum. A plurality of seat modules 12, formed of any suitable high strength moldable material, e.g., a polymeric material such as high density polyethylene, are mounted on and supported by framework 10 in adjacent side-by-side relationship. In the embodiment shown, the seat modules 12 are formed of a blow-molded polymeric material having a curved shape for the comfort of the user. A plurality of lines 11 formed in the seat modules can be provided to disguise mold lines of an expandable mold for different size seats which may be used in curved stadium sections or for custom-sized seating, the lines giving seats of different size an appearance of uniformity.

The framework 10 includes a pair of parallel rails 15 and 16 having top planar surfaces 15*a* and 16*a* which support the modular seat units 12 along the front and rear in a slightly rearwardly inclined position. A slight rearward inclination of seat module 12 facilitates drainage of rain water from the seat modules towards the rear.

Rails 15 and 16 are interconnected by crossbars 17, the crossbars 17 supporting the rails 15 and 16 above a vertical riser support member 18. The cross-section of the crossbar 17 and the riser member 18 can be of any suitable configuration to give the requisite strength to the framework 10. In the embodiment illustrated, the crossbar 17 is a T-shaped member and the riser member 18 is an angular member. The riser member 18 may be mounted on a riser face 19 of a conventional step stadium base. Alternatively, crossbar 17 can be supported from the tread 20 by means fixing the crossbar to the tread. In the embodiment shown, riser member 18 is attached to riser 19 by means of a plurality of studs 21 (one shown in FIG. 1). Crossbar 17 is attached to riser member 18 by a nut and bolt combination 22.

Module 12 is provided with front and rear overhanging lips 30 and 31, respectively, which overhang respective rails 15 and 16 to fix modules 12 on framework 10 in the direction transverse thereto.

Adjacent side-by-side modules 12 are fixed in position in adjacent side-by-side relationship by clamp-down member 60 extending over adjacent side portions 27 of adjacent seat units 12. The clamp-down members are attached to rails 15 and 16 by means of self-drilling and self-tapping screws 41 inserted into the respective top surfaces 15*a* and 16*a* of rails 15 and 16. The planar top portions of rails 15 and 16 into which self-tapping screws 41 are fastened advantageously are of heavy-duty thickness, e.g., 3/16 inch aluminum, to securely hold the self-tapping screws. For aligning the screws during assembly, score lines 35 and 36 can be provided in the top surfaces 15*a* and 16*a* of respective rails 15 and 16. Self-tapping screws 41 pass through corresponding passageway formed by semi-circular slots S provided in the sides of seat module units 12 to sandwich adjacent side portions 27 of adjacent seat units 12 between the clamp-down members 60 and the framework 10. See FIGS. 1 and 2. A slight gap is allowed between adjacent seat modules 12 to provide for expansion and contraction of the seat modules due to temperature changes. Annular gaps are also provided between screws 41 and corresponding passageways formed by slots S.

Cross-members 17 are fastened to rails 15 and 16 by means of self-tapping screws 32.

An end cap 140 (one shown in FIG. 1) extends between and covers the ends of rails 15 and 16 at each row end. End caps 140 are fastened to rails 15 and 16 by means of self-tapping screws 142.

Upright backrest supports 111 for supporting backrest modules 112 above seat units 12 are attached to and supported by corresponding clamp-down members 60. In the embodiment shown, an armrest 113 extends between a corresponding clamp-down member 60 and backrest support 111. Armrest 113 may be of oval cross-section or any suitable high-strength cross-section. Advantageously, the backrest support 111, clamp-down member 60 and armrest 113 is formed as a one-piece casting made from high-strength shock-resistant aluminum alloy.

Positioned on the rear of backrest support 111 are a pair of oppositely facing generally U-shaped, sidewardly open slots 115 for mating with and supporting a corresponding side portion 130 or 132 of a backrest module 112. The U-shaped slots are defined by front and rear wall portions 120 and 122 connected by a slot bottom wall portion 124. The U-shaped slots have open tops which are selectively closeable by a top cap 114 which is fastenable by means of one or more screws 134 to backrest support 111 to connect the front and rear wall portions 120 and 122 and thereby form a top wall portion 126 of the slot. With top cap 114 removed, the side portions 130, 132 of seat backs 112 are vertically slidable within the open U-shaped slots 115 between the front and rear slot wall portions 120, 122 to insert or remove a backrest module from corresponding backrest supports. Fastening top caps 114 with the backrest modules inserted in slots 115 interconnects the backrest assembly and secures the backrest module to the backrest support. This arrangement permits replacement of a single backrest module 112 in the event of damage, without removing support for immediately adjacent backrest modules.

In the embodiment shown, lines 140 are molded into backrest modules 112 to disguise mold lines of different sized backrest modules and to provide a uniform appearance of the backrest modules and seat modules. Sufficient clearance is provided between seat back modules 112 and the walls of U-shaped slot 115 to provide for contraction and expansion of the seat back modules due to temperature changes.

In accordance with the method of this invention, modular stadium seating is assembled by marking riser mount locations 200 and 202 for respective top and bottom rows 204 and 206 of a seating section on a stepped stadium base. See FIG. 4. The stepped stadium base includes rows of substantially vertical risers 19 separated by rows of substantially horizontal treads 20.

Figure 4:
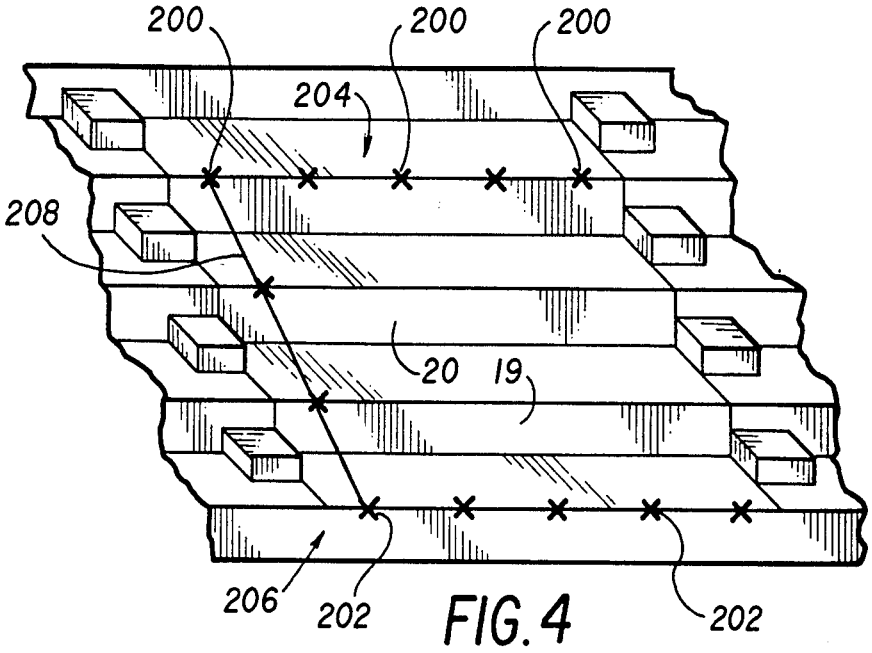
FIGS. 4–10 are partly schematic perspective views illustrating sequential assembly of the supporting framework illustrated in FIG. 1 according to one method of the invention.

The seating section on the stepped base is for a predetermined plurality of rows of seats, four rows of which are shown in FIG. 4 with a predetermined and equal number of mount locations per row, five of which are shown. Between top row 204 and 206 are intermediate rows, two of which are shown, each row including mount locations at opposite ends of the row and a plurality of intermediate mount locations therebetween.

After marking riser mount locations 200 and 202 for respective top and bottom rows 204 and 206, mount locations for intermediate rows are marked in a line extending between corresponding mount locations 200 and 202 of the top and bottom rows 204 and 206. Line 208 can be a chalk or mason line strung between marks at corresponding top and bottom locations 200 and 202. This step is repeated until all mount locations for a section are marked.

For pie-shaped seating sections, the section is divided into groups of rows having equal number of mount locations per row, followed by the mount location marking steps outlined above.

A vertical mount location plumb line 212 is marked, e.g., using a carpenter's level 214, on corresponding risers 19 at each mount location. See FIG. 5.

Figure 5:
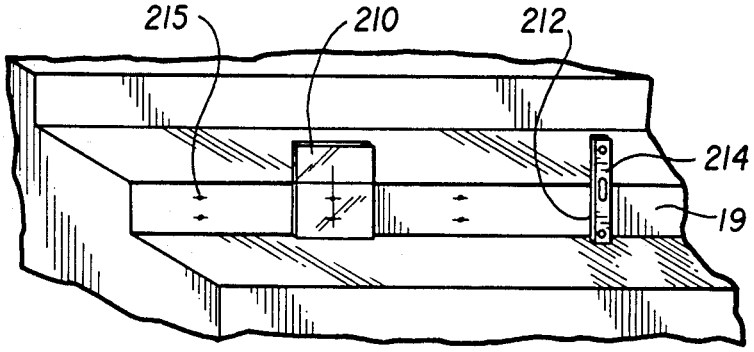

A plurality of riser holes 215 are formed at each mount location (two such holes shown at mount locations in FIG. 5). Advantageously, the riser holes are formed by drilling after marking their positions using a template 210. The drilling template may be formed, for example, of optically transparent plastic material. The template is moved from one plumb line to another to mark hole locations on the risers for drilling. Holes are then drilled in the risers at the template marks.

Figure 6:
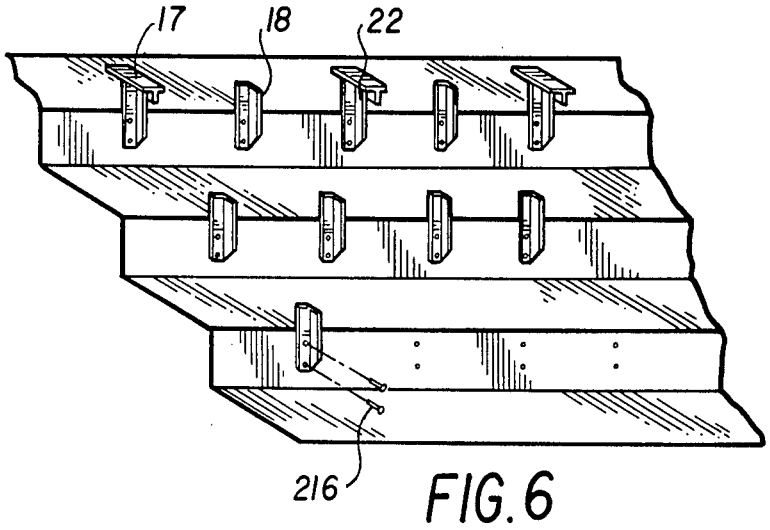

A vertical riser mount 18 is fastened at each mount location using, for example, masonry anchors 216, inserted into the riser holes at each mount location. See FIG. 6.

According to this embodiment, cross-members 17 are loosely attached to riser mounts 18 at opposite ends of the rows and to an intermediate riser mount generally centrally located in a row using nut and bolt combination 22 passing through complementary openings in a corresponding cross-member and riser mount. Note that in FIG. 2, cross-member 17 includes a pair of centrally offset openings 217 to allow the cross-member 17 to be rotated 180° prior to attachment to facilitate alignment of openings 217 with corresponding holes in the vertical riser mounts.

Referring back to FIG. 6, prior to tightening nut and bolt combination 22, the front of each cross-member is lifted to rearwardly incline the cross-members.

Figure 7:
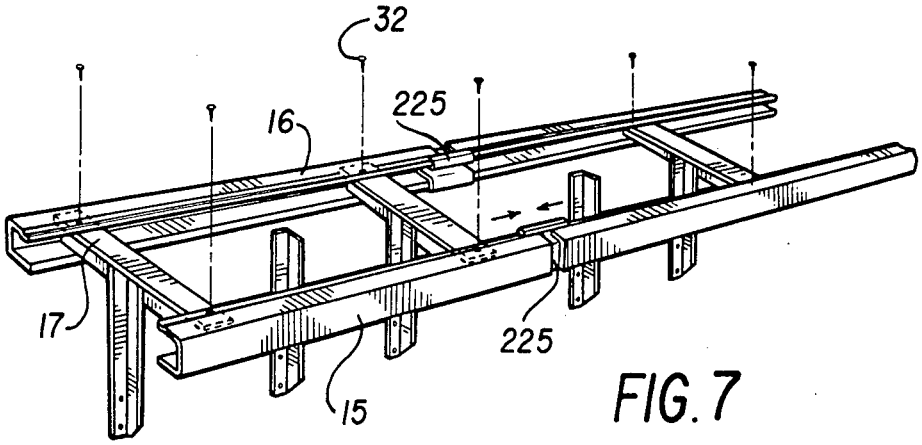
Figure 15:
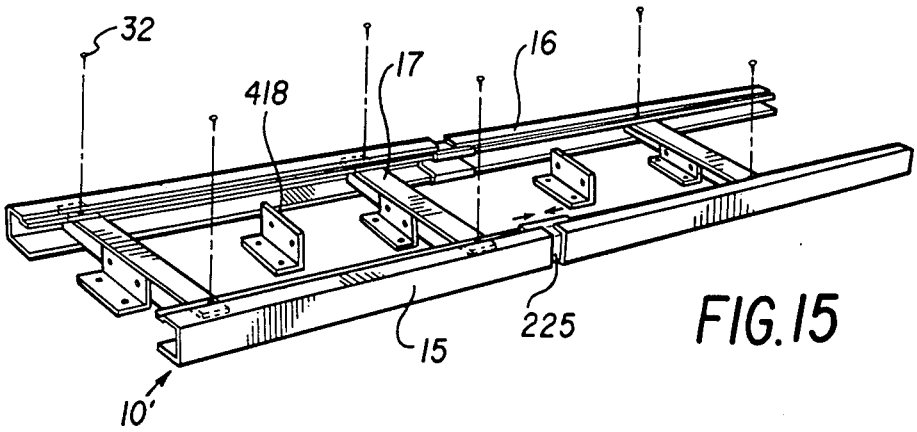
Figure 16:
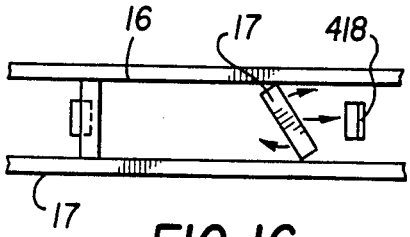
Figure 17:
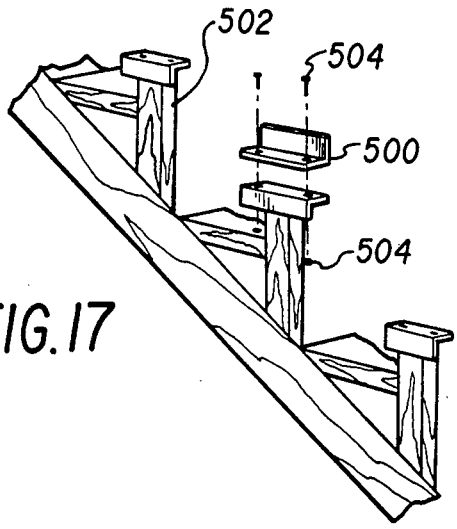
FIGS. 17–19 are partly schematic, perspective views illustrating assembly of a supporting framework according to another embodiment of the invention.

The nut and bolt combinations 22 are securely tightened to form rearwardly inclined generally T-shaped tower brackets inclined at about the same angle at the end and intermediate row locations. Front and rear elongate rail members 15 and 16 are hung on respective front and rear ends of the cross-member 17 of the end tower brackets and the intermediate tower bracket of a row, then fastened thereto with self-drilling screws 32 to securely interconnect the end tower brackets and the intermediate tower bracket of a row. See FIG. 7. If more than one rail length is required for the front or rear rails, rails can be coupled end-to-end using a rail coupler 225 which fits within and mates with rail lengths to join the rails. See FIGS. 7, 11 and 15.

Figure 8:
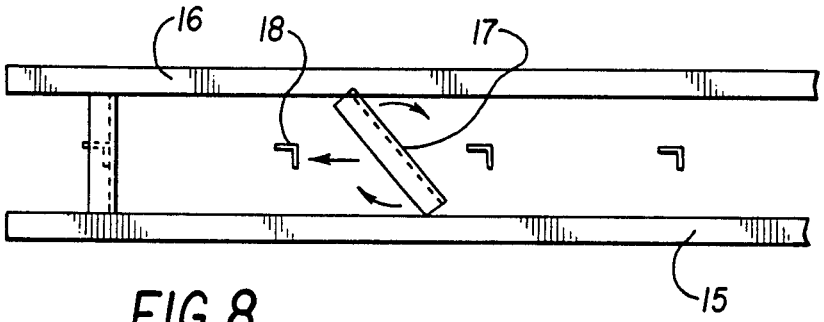
Figure 9:
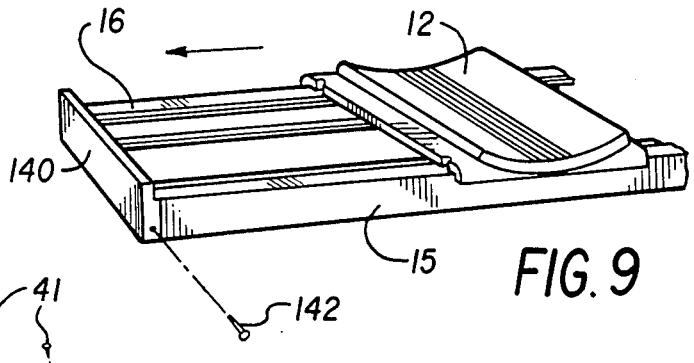
Figure 10:
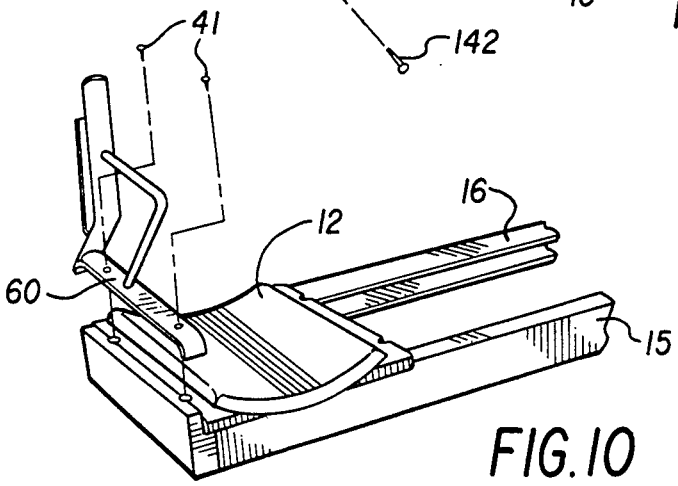
Figure 14:
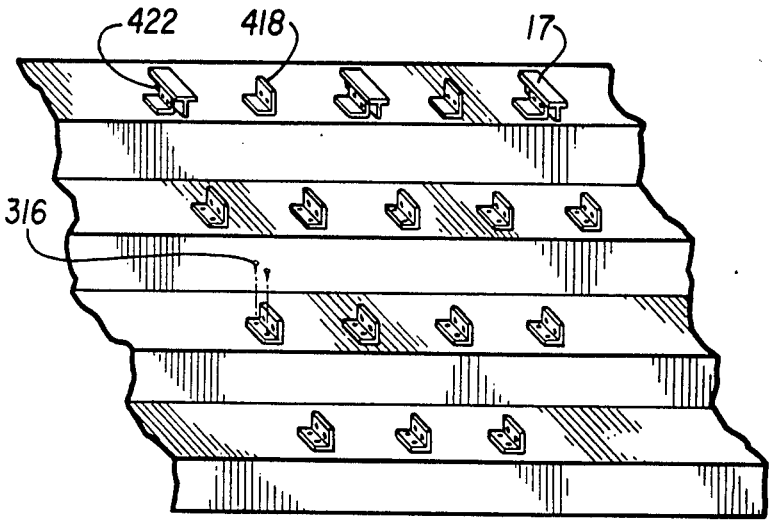

Cross-members are fastened to the remaining intermediate riser mounts and to each of the rails in a row at about the same angle of inclination to interconnect the remaining intermediate riser mounts and the rails in a row and thereby form a seat-supporting framework 10. This can be accomplished by cocking a remaining cross-member to fit between the front and rear rails and then sliding the cross-member into position against a corresponding riser mount where it is fixed by a nut and bolt combination 22. See FIG. 8.

Modular seating units are hen be mounted on the thus assembled framework. See FIGS. 1, 2, 9 and 10. The end caps 140 are slid onto the ends of front and rear rails 15 and 16 of a row and secured thereto with self-tapping screws 142 to connect the ends of the front and rear rails of a row. A first seat module 12 is placed on the rail with lips 30 and 31 overhanging respective front and rear rails 15 and 16. The first seat module is then slid against the end cap adjacent the end cover.

A clamp-down member 60 then is positioned over a side portion 27 of the first seat module adjacent the end cover and fastened to the front and rear rails 15 and 16 with self-tapping screws 41, thereby sandwiching the end portion 27 of the seat module between the clamp-down member and the front and rear rails. Additional seat members then are positioned in adjacent side-by-side relationship away from the first seat module along the row, and fastened to the front and rear rails with additional clamp-down members, the adjacent side portions 27 of adjacent seat modules 12 being sandwiched between the clamp-down members and the rails. A slight gap is allowed between adjacent side portions 27 of adjacent seat modules 12 to provide for expansion and contraction of seat modules due to temperature changes. Gap positioning can be facilitated by marking specific locations for selected clamp-down members, for example, at every tenth clamp-down member (e.g., separated by 180 inches for seats which are just under 18 inches wide, or separated by 200 inches for seats which are just under 20 inches wide). Seat modules then are evenly distributed between the marks with each tenth seat in alignment with the markings prior to fastening the clamp-down members to the rails.

Back modules 112 then are slipped into slots 115 of adjacent upright backrest supports 111 and top caps 114 fastened with screws 134 to complete assembly. If desired, screws 135 can be passed through rear slot wall 122 into a corresponding backrest end portion to further secure the backrest to the backrest support. See FIG. 2.

According to another embodiment, stadium seating according to the invention is assembled on and fixed to stadium treads. See FIGS. 12–17.

Modular stadium seating is assembled on treads by marking tread mount locations 300 and 302 for respective top and bottom rows 304 and 306 of a seating section on a stepped stadium base. See FIG. 12. As in the above-described embodiment, the stepped stadium base includes rows of substantially vertical risers 19 separated by rows of substantially horizontal treads 20.

The seating section on the stepped base is for a predetermined plurality of rows of seats, four rows of which are shown in FIG. 12 with a predetermined and equal number of mount locations per row, five of which are shown. Between top row 304 and 306 are intermediate rows, two of which are shown, each row including tread mount locations at opposite ends of the row and a plurality of intermediate tread mount locations therebetween.

After marking tread mount locations 300 and 302 for respective top and bottom rows 304 and 306, mount locations for intermediate rows are marked in a line extending between corresponding mount locations 300 and 302 of the top and bottom rows 304 and 306. Line 308 can be a chalk or mason line strung between marks at corresponding top and bottom locations 300 and 302. This step is repeated until all mount locations for a section are marked.

For pie-shaped seating sections, the section is divided into groups of rows having equal number of mount locations per row, followed by the mount location-marking steps outlined above.

A plurality of tread holes 315 are formed at each mount location (two such holes shown at mount locations in FIG. 13). Advantageously, the tread holes are formed by drill 309 marking their positions using a template 310. As above, the drilling template may be formed of optically transparent plastic material. The template includes a tread edge alignment stop 311, formed, for example, from a block of wood. The template is moved from one tread mount location to another to mark hole locations on the treads for drilling. Holes are then drilled in the treads at the template marks.

An angular tread mount 418 is fastened at each mount location using, for example, masonry anchors 316, inserted into corresponding tread holes. See FIG. 14.

Figure 2:
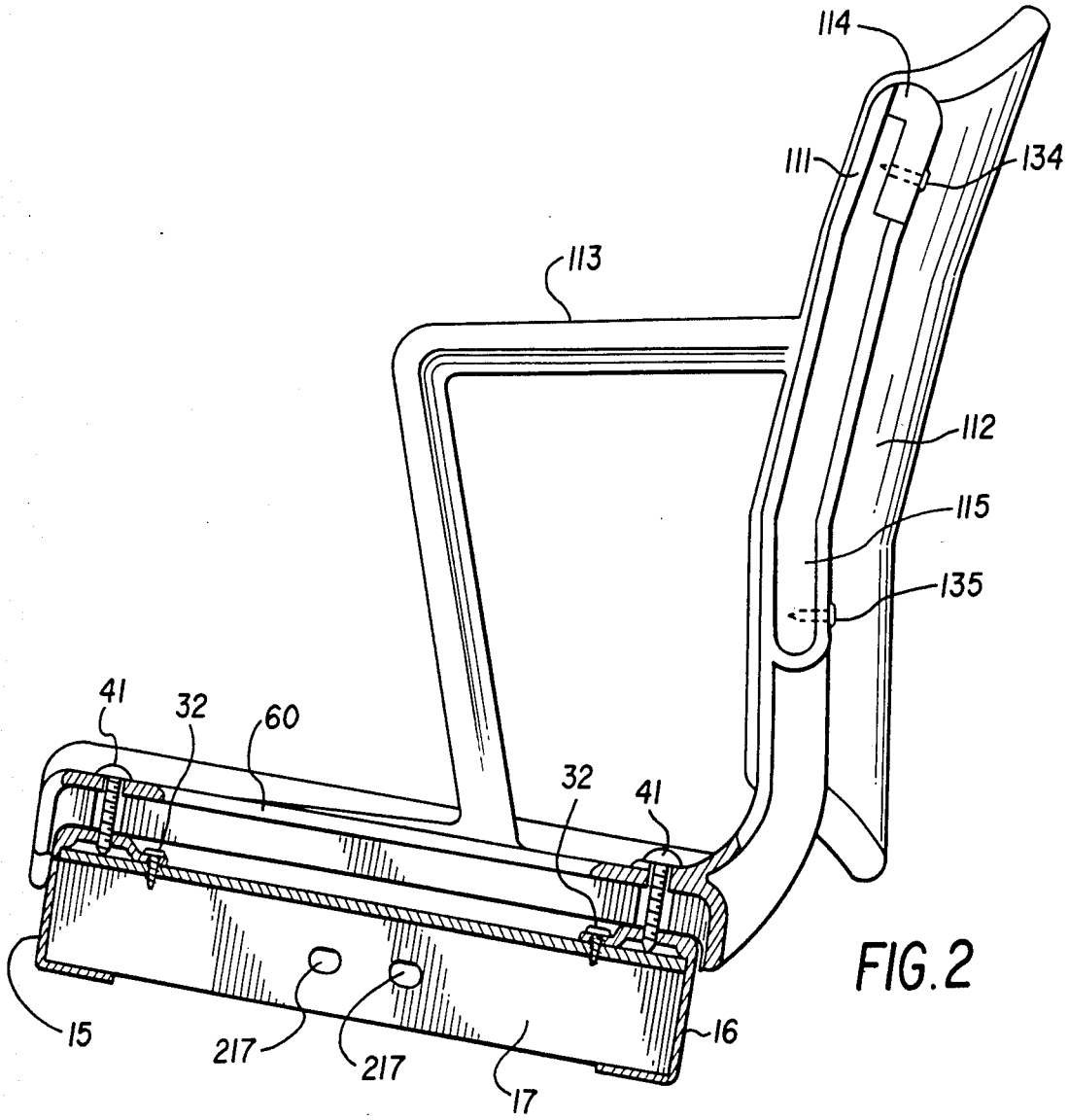
FIG. 2 is a side elevation view in partial cross-section of assembled modular seating according to the present invention.
Figure 3:
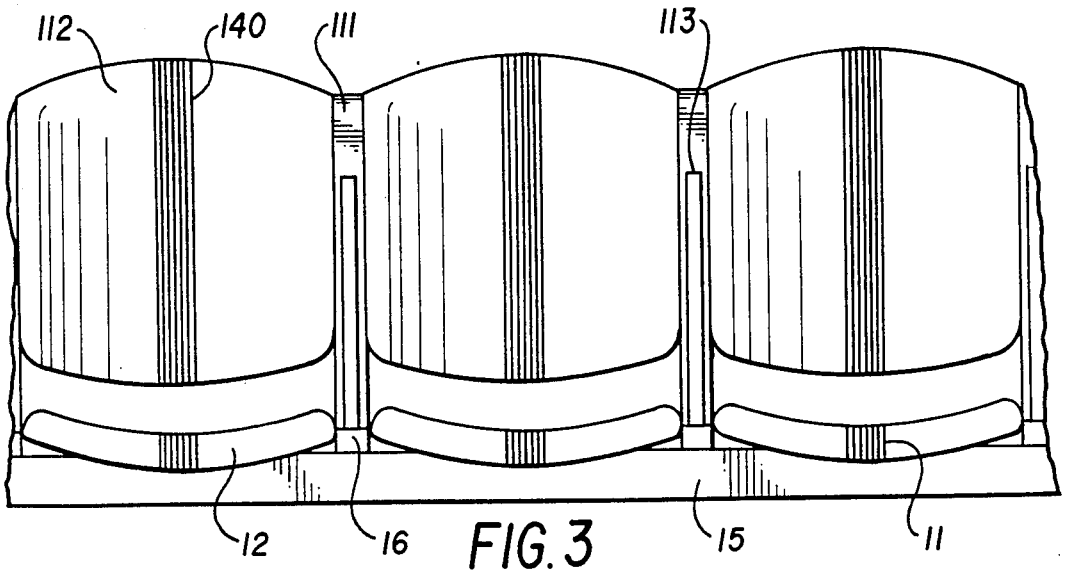
FIG. 3 is front elevation view of a plurality of assembled seating units.

According to this embodiment, cross-members 17 are loosely attached to tread mounts 418 at opposite ends of the rows and to an intermediate tread mount generally centrally located in a row using nut and bolt combinations 422 passing through complementary openings in a corresponding cross-member and tread mount. As shown in FIG. 2, cross-member 17 includes a pair of centrally offset openings 217 to allow the cross-member 17 to be rotated 180° prior to attachment to facilitate alignment of openings 217 with corresponding holes in the tread mounts.

Referring back to FIG. 15, prior to tightening nut and bolt combinations 422, the front of each cross-member is lifted to rearwardly incline the cross-members. The nut and bolt combinations 422 are securely tightened to form rearwardly inclined fixed tread brackets inclined at about the same angle at the end and intermediate row locations. Front and rear elongate rail members 15 and 16 are hung on respective front and rear ends of the cross-members 17 of the end tread brackets and the intermediate tread bracket of a row, then fastened thereto with self-drilling screws 32 to securely interconnect the end tread brackets and the intermediate tread bracket of a row. See FIG. 15. As above, if more than one rail length is required for the front or rear rails, rails can be coupled end-to-end using a rail coupler 225 which fits within and mates with rail lengths to join the rails. See FIGS. 11 and 15.

Cross-members are fastened to the remaining intermediate tread mounts and to each of the rails in a row at about the same angle to interconnect the remaining intermediate tread mounts and the rails in a row and thereby form a seat-supporting framework 10'. This can be accomplished by cocking a remaining cross-member to fit between the front and rear rails and then sliding the cross-member into position against a corresponding tread mount where it is fixed by a nut and bolt combination. See FIG. 16.

Modular seating units can then be mounted on the thus assembled framework as described above in connection with riser mounted framework.

Figure 18:
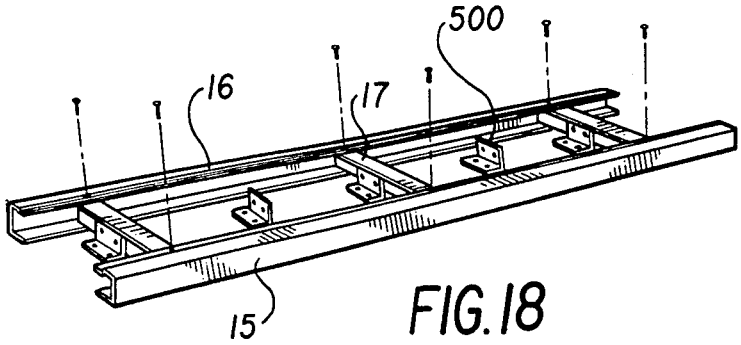
Figure 19:
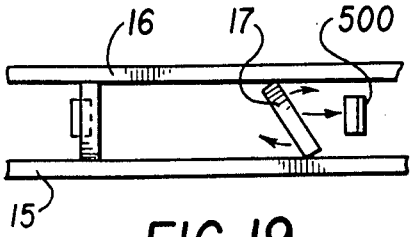

In yet another embodiment, stadium seating according to the invention is installed on existing steel grandstands. See FIGS. 17–19. Rectangular transition brackets 500 are mounted on existing vertical plank mounts 502 on the understructure of the grandstand using attachment nut and bolt combinations 504 or other suitable means. Cross-members are loosely attached to angular transition brackets at the row ends and at an intermediate angular transition bracket generally centrally located in a row. The cross-members then are leveled and fixedly attached to the transition brackets by a nut and bolt combination. The front and rear rail members then are hung and fastened to the cross-members and remaining cross-members attached prior further assembling the modular seating as described above.

Figure 20:
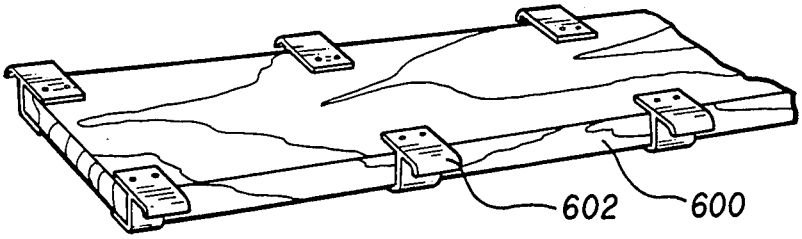
FIG. 20 is a partly schematic perspective view of a supporting framework according to yet another embodiment of the invention.

In still another embodiment, modular seating according to the invention is assembled on existing plank stadium seating wherein a row comprises a plank 600 of wood, aluminum or other material. See FIG. 20. A plurality of generally T-shaped rectangular plank extenders 602 are attached to front and rear edges of a plank starting at the end of a row so that the centerline of each plank extender 602 lines up with centerlines of each narrow gap between seat modules. For sections having rows with equal numbers of seats, the top and bottom plank rows can be marked at each plank extender location with a mason line or chalk line between corresponding marks of top and bottom rows to mark the front edge of planks on all intermediate rows. End caps, such as end cap 140 described above, then are slid onto the ends of the plank and secured with self-tapping screws, and a first seat module, such as described with reference to FIG. 1, is placed on the plank system adjacent the end cap. A clamping member then is installed over an edge portion of the seat module and fastened to the plank extenders with self-tapping screws to sandwich the edge portion of the seat module between the plank and the clamping member. Seat modules are then serially added in side-by-side relationship with the clamping members being fixedly attached to the plank extenders to complete the rows.

The present invention provides a modular stadium seat assembly which is durable, economical and easy to assemble. The assembly allows removal of a single backrest module for replacement or repair without removing support for adjacent backrest modules. The invention further provides a method for assembling stadium seating which easily may be utilized for both curved and straight seating sections in a time and material efficient manner.

Since many modifications, variations and changes in detail may be made to the described embodiments, it is intended that all matter in the foregoing description and shown in the accompanying drawings be interpreted as illustrative and not in a limiting sense.

What is claimed is:

1. A modular stadium seat assembly comprising:

(a) a plurality of adjacent side-by-side modular seat units, each including generally centrally located mold lines formed therein and a plurality of other centrally located lines formed therein for disguising said mold lines;

(b) a support framework for supporting the seat units in side-by-side relationship above a stadium support structure, the support framework including front and rear laterally extending parallel rails positioned beneath the seat units and supporting front and rear portions respectively of the adjacent side-by-side modular seat units, the front rail being connected to the rear rail by a plurality of rearwardly inclined cross-members extending between and attached to the front and and rear rails so that the modular seat units incline rearwardly between the front and rear rails;

(c) a plurality of adjacent backrest modules, each including generally centrally located mold lines formed therein and a plurality of other centrally located lines formed therein for disguising said mold lines, the backrest modules being positioned side-by-side above corresponding seat units to engage and rest a user's back;

(d) clamp-down members extending over adjacent side portions of adjacent seat units;

(e) self-drilling, self-tapping screws for attaching the clamp-down members to the front and rear rails of the seat unit supporting means with adjacent side portions of adjacent seat units sandwiched between the clamp-down members and the rails of the seat unit supporting means;

(f) a score-line groove extending along a top surface of each of said rails for alignment of said self-drilling, self-tapping screws; and (g) upright backrest supports for supporting the backrest modules above the seat units, the backrest supports being attached to and supported by corresponding clamp-down members, the upright support including generally U-shaped, sidewardly open slots for mating with and supporting corresponding side portions of the backrest modules, the U-shaped slots being defined by front and rear wall portions connected by a slot bottom wall portion, the U-shaped slot having an open top which is selectively closable by a top cap which is screw-fastenable to the assembly to connect the front and rear wall portions and thereby form a top wall portion of the slot, the side portions of the seat backs being vertically slidable within open U-shaped slots between the front and rear slot wall portions when the top caps are unfastened to insert or remove the backrest modules from the backrest supports, wherein screw-fastening of the top caps with the backrest modules inserted in the slots interconnects and secures the backrest modules with the backrest supports.

2. The assembly of claim 1 further including a plurality of armrests extending between corresponding clamp-down members and backrest supports.

3. The assembly of claim 1 wherein the stadium support structure is a stepped stadium base above which the front and rear rails are supported.

4. The assembly of claim 3 wherein the clamp-down members are attached to the rails by screws passing through corresponding passageways formed in adjacent side portions of adjacent seat units.

5. The assembly of claim 3 wherein the cross-members are attached to the rails by means of screws.

6. The assembly of claim 3 wherein the cross-members are attached to upright rail supports which rail supports are attached to said stepped stadium base.

7. The assembly of claim 6 wherein the cross-members are attached to the upright rail supports by screws.

8. The assembly of claim 6 wherein said stepped stadium base includes risers to which said upright rail supports are attached.

9. The assembly of claim 6 wherein said stepped stadium base includes treads to which said upright rail supports are attached.

10. The assembly of claim 1 wherein at least one of said rails includes coupler means for coupling a plurality of rail sections to form a rail.

* * * * *

UNITED STATES PATENT AND TRADEMARK OFFICE

CERTIFICATE OF CORRECTION

PATENT NO. : 4,790,594

DATED : DECEMBER 13, 1988

INVENTOR(S) : ULIS J. TEMOS

It is certified that error appears in the above-identified patent and that said Letters Patent is hereby corrected as shown below:

Column 2, line 3, delete "supoorts" and substitute therefor -- supports --;

Column 6, line 6, delete "hen" and substitute therefor -- then --;

Column 8, line 68, delete "and" (second occurrence).

Signed and Sealed this

Thirteenth Day of March, 1990

*Attest:*

JEFFREY M. SAMUELS

*Attesting Officer*

*Acting Commissioner of Patents and Trademarks*